United States Patent [19]

Wada et al.

[11] Patent Number: 4,613,838

[45] Date of Patent: Sep. 23, 1986

[54] DIELECTRIC RESONATOR

[75] Inventors: Hidekazu Wada, Kobe; Youhei Ishikawa, Kyoto, both of Japan

[73] Assignee: Murata Manufacturing Co., Ltd., Japan

[21] Appl. No.: 770,839

[22] Filed: Aug. 29, 1985

[30] Foreign Application Priority Data

Aug. 31, 1984 [JP] Japan ..... 59-183204

[51] Int. Cl.[4] ..... H01P 7/10; H01P 7/06

[52] U.S. Cl. ..... 333/232; 333/226; 333/235

[58] Field of Search ..... 333/202, 204, 205, 219, 333/235, 206-212, 222-224, 226, 227, 230-232, 245, 248; 331/96, 107 DP, 107 C, 117 D, 107 SL

[56] References Cited

U.S. PATENT DOCUMENTS 3,713,051 1/1973 Kell ..... 333/205
4,521,746 6/1985 Hwan et al. ..... 333/219 X

FOREIGN PATENT DOCUMENTS 0039042 4/1978 Japan ..... 333/235
0141803 11/1980 Japan ..... 333/219
0150203 9/1982 Japan ..... 333/219

*Primary Examiner*—Marvin L. Nussbaum
*Attorney, Agent, or Firm*—Ostrolenk, Faber, Gerb & Soffen

[57] ABSTRACT

A dielectric resonator employing $TM_{010}$ mode or its variation mode, and including a cavity resonator and a columnar inner dielectric member accommodated within the cavity resonator a region being formed at an end face of the inner dielectric member so as not to contact the cavity resonator, and a resonant frequency adjusting member being adapted to be movable toward or away from the region, thus adjusting the resonant frequency through variation of a capacitance value in a path passing through the columnar dielectric member, the resonant frequency adjusting member, and the cavity resonator.

15 Claims, 8 Drawing Figures

DIELECTRIC RESONATOR

BACKGROUND OF THE INVENTION

The present invention generally relates to an electrical resonator and more particularly, to a dielectric resonator employing $TM_{010}$ mode or its variation mode for electromagnetic waves.

The construction of the dielectric resonator of this kind in terms of principle has already been known, and there are various problems to be solved for the actual applications, one of which problems is related to a resonant frequency adjusting construction, which are conventionally disclosed, for example, in Japanese Utility Model Laid-Open Publications Jikkaisho No. 59-57005 and No. 59-88908, and so arranged as shown in FIG. 1, that a frequency adjusting member 4 made of a metal or dielectric member is inserted into a space 3 defined between an inner peripheral surface of a metallic case 2 closed at its opposite ends and a columnar inner dielectric member 1 disposed at a central portion within said case 2. The frequency adjusting member 4 made of a metal is not suitable for actual application, since a loss tends to be large. In the case where the frequency adjusting member 4 is of a dielectric material, it is assumed that the resonant frequency is altered through variation of a capacitance value in an equivalent circuit when the resonant frequency of the resonator is to be considered. However, in the known construction as referred to above, since the frequency adjusting member 4 is located at a place where the density of electric lines of force is low, the resonant frequency can not be effectively altered. Moreover, due to the fact that the capacitance considered between the frequency adjusting member 4 and the surface of the metallic case 2 confronting said frequency adjusting member 4 on an extension line thereof, is small as compared with the capacitance of the frequency adjusting member itself, values of such capacitances are not much altered even when the adjusting member 4 is moved to a large extent upon consideration of a combined capacitance, and it has been impossible to effectively alter resonant frequencies by the known constructions.

By way of example, when the resonant frequency was represented by fo and frequency variable range was denoted by $\Delta f$, the only relation obtainable was $$\Delta f/fo \leqq 0.2\%.$$

If it is intended to obtain the frequency variable range larger than the above, unloaded Q factor (=Qo) is undesirably lowered to a large extent. For example, on the assumption that the range of lowering of the unloaded Q factor (=Qo) is represented by $\Delta Qo$, the resultant relation would undesirably be $$\Delta Q/Qo \geqq 10\%.$$

This is considered to be attributable to the fact that, owing to the construction, the current is concentrated upon the resonant frequency adjusting mechanism and a loss is produced by a contact resistance thereof.

SUMMARY OF THE INVENTION

Accordingly, an essential object of the present invention is to provide an improved dielectric resonator employing $TM_{010}$ mode or its variation mode, and provided with a resonant frequency adjusting mechanism large in the resonant frequency variable range, without reduction of unloaded Q factor.

Another important object of the present invention is to provide a dielectric resonator of the above described type which is simple in construction and stable in functioning, and can be readily manufactured on a large scale at low cost.

In accomplishing these and other objects, according to one preferred embodiment of the present invention, there is provided a dielectric resonator employing $TM_{010}$mode or variation mode thereof, and including a cavity resonator and a columnar inner dielectric member accommodated within the cavity resonator, and characterized in that there are provided a region formed at an end face of said inner dielectric member so as not to contact said cavity resonator, and a resonant frequency adjusting member adapted to be movable toward or away from said region, thereby to adjust the resonant frequency through variation of capacitance value in a path passing through said columnar dielectric member, resonant frequency adjusting member, and cavity resonator.

Furthermore, in a modification according to the present invention, said region is further formed with a recess, and the resonant frequency adjusting member is arranged to be movable toward or away from said recess for the adjustment of the resonant frequency.

By the arrangement according to the present invention as described above, an improved dielectric resonator has been advantageously presented through simple construction.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
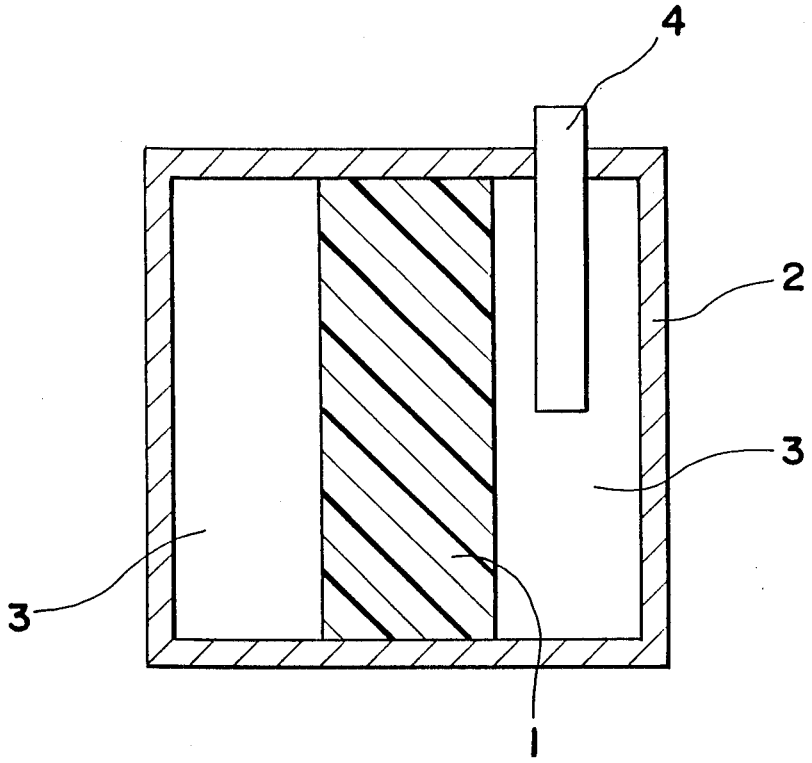
Fig. 1 PRIOR ART
FIG. 1 is a side sectional view of a conventional dielectric resonator.

Before the description of the present invention proceeds, it is to be noted that like parts are designated by like reference numerals throught the accompanying drawings.

Figure 2:
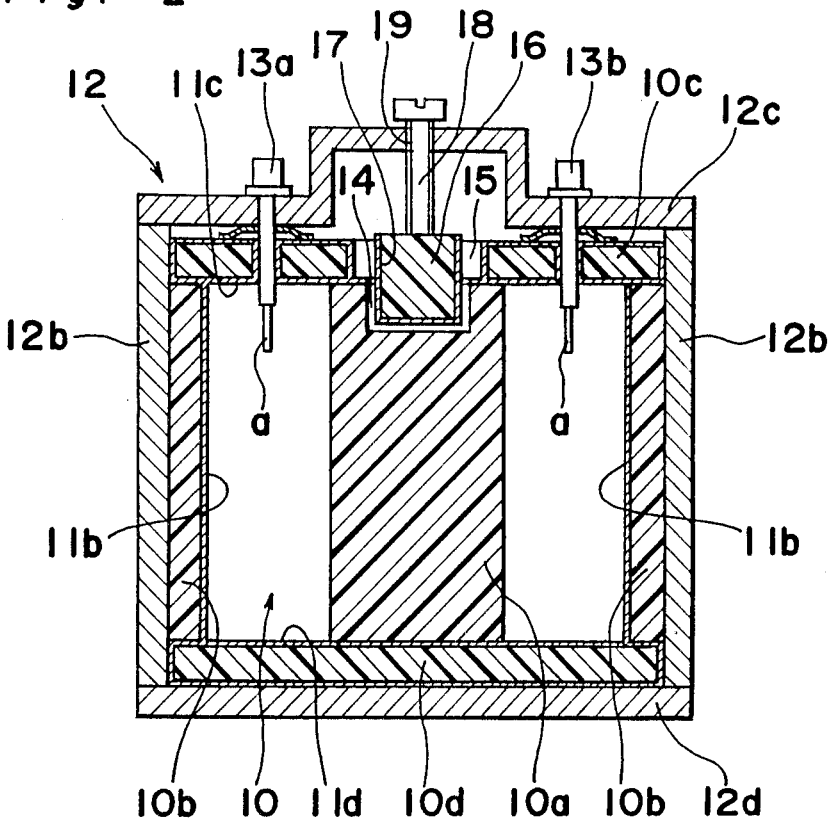
FIG. 2 is a side sectional view of a dielectric resonator according to one preferred embodiment of the present invention.

Referring now to the drawings, there is shown in FIG. 2 a main portion 10 of a dielectric resonator of the present invention employing $TM_{010}$ mode or variation mode thereof, which includes a columnar inner dielectric member 10*a*, a cylindrical dielectric member 10*b* made of a material having the same thermal expansion coefficient as that of the inner dielectric member 10*a*, and concentrically surrounding said inner dielectric member 10*a* in a spaced relation therefrom, disc-like dielectric members 10*c* and 10*d* also made of a material having the same thermal expansion coefficient as that of the cylindrical dielectric member 10*b* and provided to close opposite open ends of said cylindrical dielectric member 10*b*, and electrode layer 11*b* applied onto the inner peripheral surface of the cylindrical dielectric member 10*b*, and electrode layer 11*c* provided over the entire outer surface of the disc-like dielectric member 10*c*, and another electrode layer 11*d* provided over the entire outer surface of the disc-like dielectric member 10*d*, with the respective electrode layers 11*b*, 11*c* and 11*d* being adapted to be continuous onto each other to provide a function equivalent to that of the opposite end closed cylindrical metallic case 2 in the known typical resonator of FIG. 1, and with the opposite end faces of the inner dielectric member 10*a* being held in close contact with the electrode layers 11*c* and 11*d*.

It is to be noted here that the electrode layer 11*b* described as provided over the inner peripheral surface of the cylindrical dielectric member 10*b* in the above embodiment may be modified to be provided over the outer peripheral surface of said member 10*b*.

The main portion 10 of the dielectric resonator as described so far is accommodated in a metallic protection casing 12, which includes a cylindrical barrel portion 12*b*, an upper lid portion 12*c*, and a lower lid portion 12*d*, and input and output connectors 13*a* and 13*b* mounted on the upper lid portion 12*c* to extend therethrough and also, through the disc-like dielectric member 10*c*, with antennas a attached to center conductors of the respective connectors 13*a* and 13*b* being located in the space between the inner dielectric member 10*a* and the cylindrical dielectric member 10*b* within the main portion 10, while grounding portions of the connectors 13*a* and 13*b* are conducted to the electrode layer 11*c* of the disc-like dielectric member 10*c*.

In the upper end face of the inner dielectric member 10*a*, there is formed a recess 14, while a circular bore 15 is formed in the disc-like dielectric member 10*c* in a position corresponding to the recess 14. A columnar dielectric member 16 having a low dielectric constant is disposed within the recess 14 and the circular bore 15 to constitute a resonant frequency adjusting mechansim together with an electrode layer 17 formed on the side peripheral surface and bottom surface of the dielectric member 16, and an adjusting screw 18 connected at its lower end, to the dielectric member 16 and extending outwardly, at its upper end, from the upper lid portion 12*c*, with the intermediate threaded portion of the screw 18 being engaged with a corresponding female thread 19 formed in said upper lid portion 12.

Figure 3:
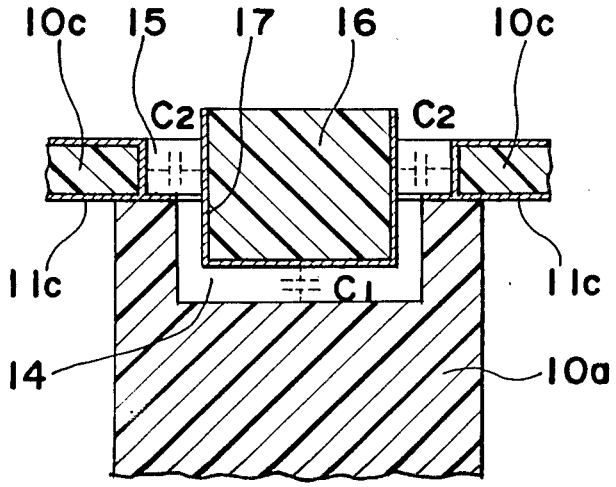
FIG. 3 is a fragmentary side sectional view showing on an enlarged scale, an essential portion of the resonator of FIG. 2.

Subsequently, functioning of the resonant frequency adjusting mechanism as referred to above will be described with reference to a diagram in FIG. 3 schematically showing the essential portion thereof.

Electric lines of force pass through the inner dielectric member 10*a* in the axial direction thereof, and therefore, capacitance C1 is present between the electrode layer 17 and the bottom face of the recess 14, while capacitance C2 is also present between the electrode layers 17 and 11c. Accordingly, when the dielectric member 16 is vertically moved in FIG. 3 by turning the adjusting screw 18, the capacitances C1 and C2 are varied. In one example, by mainly varying the capacitance C1, the resonant frequency was varied more largely than in the conventional practice in such a manner as in $\Delta f/fo \cong 2\%$. It is to be noted here that the resonant frequency may be adjusted also by conducting the electrode layers 11c and 17.

Figure 4:
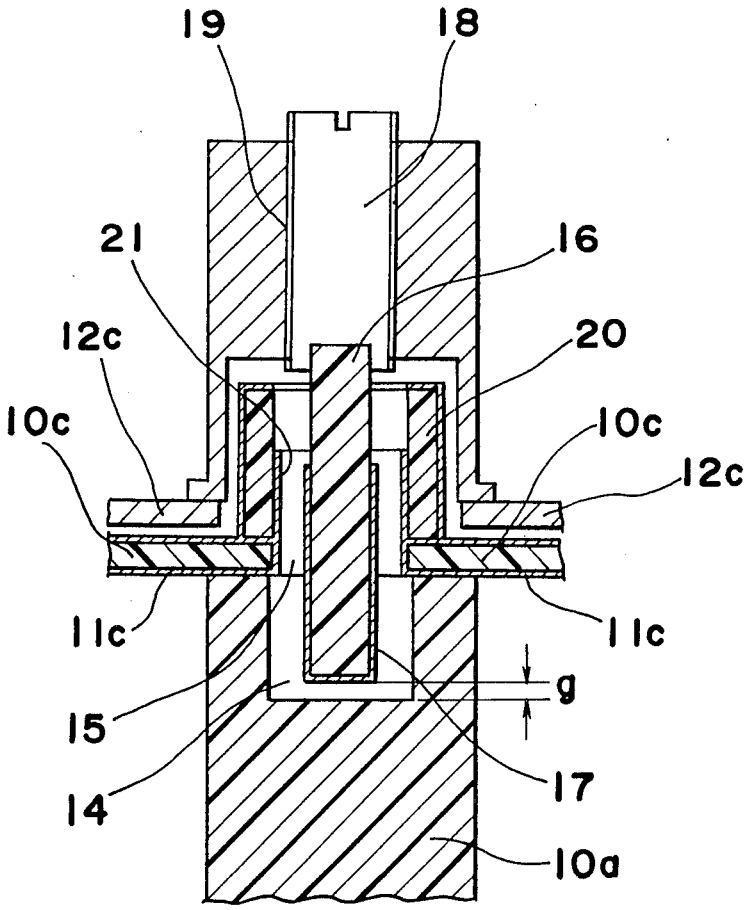
FIG. 4 is a view similar to FIG. 3, which particularly shows a modification thereof.

Referring further to FIG. 4, there is shown a modification of the resonant frequency adjusting mechanism in FIG. 3.

In the modified resonant frequency adjusting mechanism of FIG. 4, a cylindrical dielectric member 20 having, on its surface, an electrode layer 21 continuous onto the electrode layer 11c of the disc-like dielectric member 10*c* is further provided on said dielectric member 10*c*, with the columnar dielectric member 16 connected to the adjusting screw 18 for the vertical adjustment being concentrically disposed in the space or circular bore 15 within the cylindrical dielectric member 20. The portion of the electrode layer 21 provided over the inner peripheral surface of the cylindrical dielectric member 20 is so set that the capitance C2 becomes a predetermined required value. In the arrangement of FIG. 4, the value of capacitance C2 is made larger than that in FIGS. 2 and 3. The air gap between the electrode layer 17 and the bottom face of the recess 14 is represented by g.

Since other constructions and effects of the resonant frequency adjusting mechanism of FIG. 4 are generally similar to those in the mechanism of FIGS. 2 and 3, detailed description thereof is abbreviated here for brevity, with like parts being designated by like reference numerals.

Figure 5:
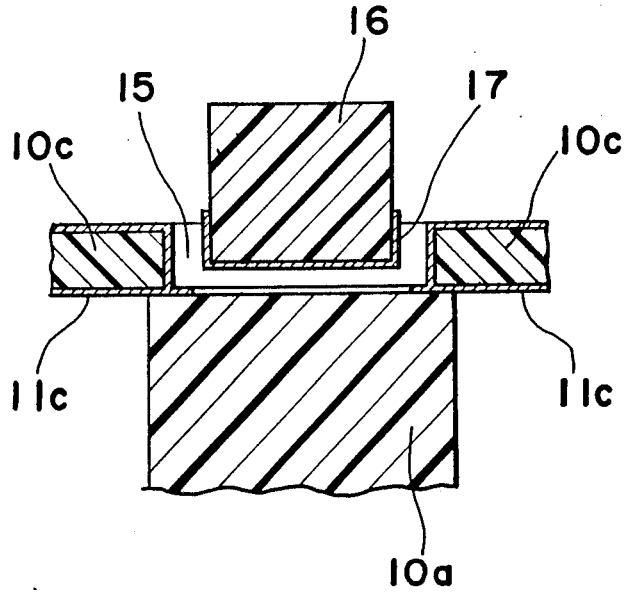
FIG. 5 is a view similar to FIG. 3, which particularly shows another modification thereof.

Referring further to FIG. 5, there is shown another modification of the resonant frequency adjusting mechanism in FIG. 3.

In the arrangement of FIG. 5, the recess 14 described as formed in the upper end face of the inner dielectric member 10*a* in the foregoing embodiments is not provided. The portion of the electrode layer 17 formed on the outer peripheral side face of the dielectric member 16 may be dispensed with. In this case, the capacitance C2 is to be formed between the electrode layer 17 formed on the bottom surface of the dielectric member 16 and the portion of the electrode layer 11*c* formed around the upper peripheral edge portion of the inner dielectric member 10*a*. By the construction as described above, in one example, the resonant frequency was varied by about $\Delta f/fo \cong 0.5\%$. It is to be noted here that the resonant frequency may also be adjusted when the electrode layer 17 formed on the outer peripheral side face of the dielectric member 16 is conducted with the electrode layer 11*c* formed on the side peripheral face of the circular bore 15.

Between the case where the recess 14 is not formed in the upper end face of the inner dielectric member 10*a* and the case where such recess 14 is formed therein, differences as follows will take place.

Figure 6:
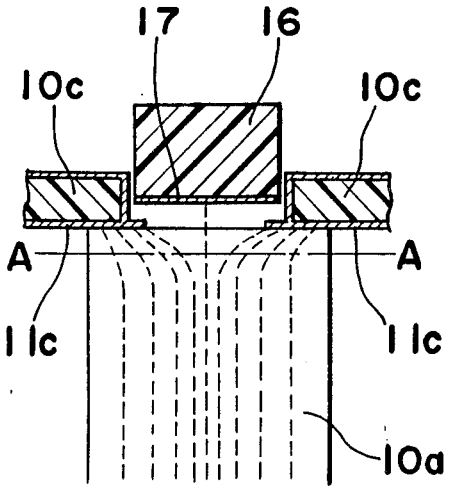
FIGS. 6 and 7 are sectional diagrams for explaining functions of the dielectric resonator according to the present invention.

In FIG. 6, upon consideration of an imaginary plane A—A immediately below the upper end face of the inner dielectric member 10*a*, when the capacitance between the imaginary plane A—A and the electrode layer 11*c* is represented by C5, the capacitance between the imaginary plane A—A and the electrode layer 17 is denoted by C6, and the capacitance between the electrode layers 17 and 11*c* is represented by C7, it is necessary to compare C5 with C8$(1/C8=(1/C6)+(1/C7))$ for studying the influence thereof on the resonant frequency.

Now, upon comparison of the values for C5 and C8, the former is considerably larger than the latter which is rather small, since for the former, the distance is short, while in the latter, the capacitances C6 and C7 are connected in series in addition to the presence of the air gap. Owing to the fact that the resonant frequency is influenced by the combined effect of both capacitances, if both are in the relation as stated earlier, it is difficult to vary the resonant frequency to a large extent by a slight variation in the value for the latter. However, due to the fact that current does not flow through such a portion, there is no reduction in the unloaded factor Q, and moreover, since the adjustment is effected at a position where density of electric lines of force is higher than that in the conventional arrangement, the resonant frequency adjusting range may be advantageously increased.

Figure 7:
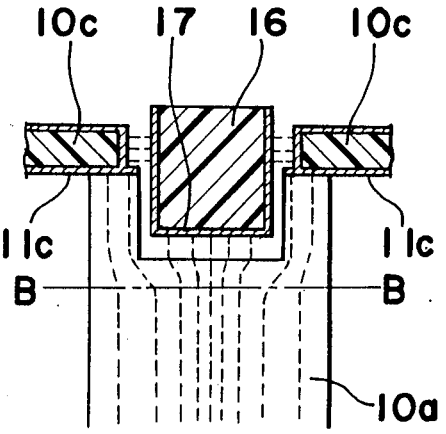

Subsequently, in FIG. 7, upon consideration of an imaginary plane B—B immediately below the upper end face of the inner dielectric member 10*a*, when the capacitance between the imaginary plane B—B and the electrode layer 11*c* is represented by C15, the capacitance between the imaginary plane B—B and the electrode layer 17 is denoted by C16, and the capacitance between the electrode layers 17 and 11*c* is represented by C17, it is necessary to compare C15 with C18$(1/C18=(1/C16)+(1/C17)$ for studying the influence thereof on the resonant frequency.

Now, upon comparison of the values for C15 and C18, the ratio of both is not so large as in FIG. 6, since for the former, there is a considerable distance in spite of the intervention of the same medium, while for the latter, the distance is considerably short as compared with the former even in the presence of the air gap, and thus, the resonant frequency is effectively altered when the value of the latter is varied. As described above, in the presence of the recess 14, there is such a merit that the resonant frequency variable range is further widened in addition to the advantage available in the absence of the recess 14.

Figure 8:
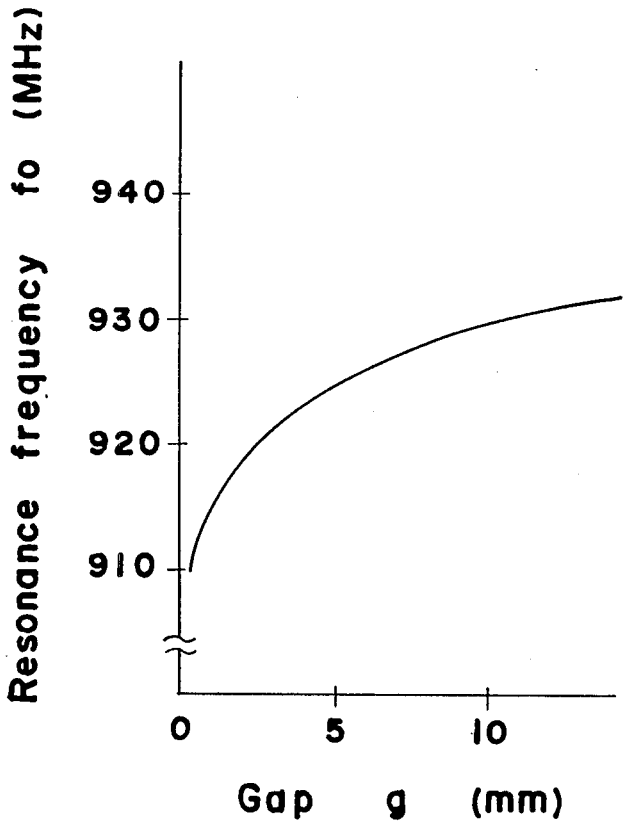
FIG. 8 is a graphic diagram showing variations of resonant frequencies.

FIG. 8 shows variations of resonant frequencies based on one example of actually measured values in the presence of the recess 14.

It should be noted here that the dielectric member 16 and the electrode layer 17 described as employed for the resonant frequency adjusting mechanism in the foregoing embodiments may be replaced by a metallic rod (not shown) attached to the adjusting screw 18 through insulation.

As is clear from the foregoing description, according to the present invention, it is so arranged that, at part of the region for joining the inner dielectric member with the cavity resonator, the region without joining is provided, and by selectively bringing the frequency adjusting member close to or away from the region, the factor equivalent to capacitance in the equivalent circuit for a dielectric resonator is varied for the adjustment of the resonant frequency. Moreover, according to the present invention, at part of the region for joining the inner dielectric member and the cavity resonator, the region without joining is provided, with the recess being further formed in said region, whereby the resonant frequency is adjusted through variation of the factor equivalent to capacitance in the equivalent circuit for a dielectric resonator by selectively bringing the frequency adjusting member close to or away from said recess.

Therefore, according to the present invention, since the frequency adjusting member is moved in the position where density of electric lines of force is conventionally high, the resonant frequency may be effectively altered. Moreover, owing to the fact that the frequency adjusting mechanism has no portion where current is concentrated, reduction of the unloaded Q factor may be almost negligible. Furthermore, since the actual construction is not specific or complicated, there is an advantage from the viewpoint of cost, while the adjusting operation is simple, without requiring skillfulness therefor.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A dielectric resonator employing $TM_{010}$ mode or variation mode thereof, comprising a support, a cavity resonator adjacent said support, a columnar inner dielectric member substantially concentrically accommodated within said cavity resonator, said dielectric member having end faces contacting respective interior surfaces of said cavity resonator, and said cavity resonator having an opening formed therein adjacent one of said end faces to provide a region at said one end face of said inner dielectric member which is out of contact with said cavity resonator, and a resonant frequency adjusting member mounted on said support and adapted to be movable toward or away from said region, to adjust the resonant frequency of said dielectric resonator through variation of a capacitance value in an electric field path passing through said columnar dielectric member, said resonant frequency adjusting member, and said cavity resonator.

2. A dielectric resonator as in claim 1, wherein said resonant frequency adjusting member includes a dielectric portion, an electrode portion being formed on said dielectric portion.

3. A dielectric resonator as in claim 1, wherein said resonant frequency adjusting member includes an elongated metallic portion.

4. A dielectric resonator as in claim 1, wherein said cavity resonator includes a dielectric portion, electrode portions being formed on said inner surfaces of said dielectric portion.

5. A dielectric resonator as in claim 1, wherein said support comprises a casing for accommodating said cavity resonator, said frequency adjusting member being mounted on said casing.

6. A dielectric resonator employing $TM_{010}$ mode or variation mode thereof, comprising a support, a cavity resonator adjacent said support, a columnar inner dielectric member substantially concentrically accommodated within said cavity resonator, said dielectric member having end faces contacting respective interior surfaces of said cavity resonator, and said cavity resonator having an opening formed therein adjacent one of said end faces to provide a region at said one end face of said inner dielectric member which is out of contact with said cavity resonator, a recess being formed in said region, and a resonant frequency adjusting member mounted on said support and adapted to be movable toward or away from said recess, to adjust the resonant frequency of said dielectric resonator through variation of a capacitance value in an electric field path passing through said columnar dielectric member, said resonant frequency adjusting member, and said cavity resonator.

7. A dielectric resonator as in claim 6, wherein said resonant frequency adjusting member includes a dielectric portion, an electrode portion being formed on said dielectric portion.

8. A dielectric resonator as in claim 6, wherein said resonant frequency adjusting member includes an elongated metallic portion.

9. A dielectric resonator as in claim 6, wherein said cavity resonator includes a dielectric portion, electrode portions being formed on said inner surfaces of said dielectric portion.

10. A dielectric resonator as in claim 6, wherein said support comprises a casing for accommodating said cavity resonator, said frequency adjusting member being mounted on said casing.

11. A dielectric resonator comprising:

a support, a cavity resonator adjacent said support, including a dielectric portion and electrode portions formed on inner surfaces of said dielectric portion, a columnar inner dielectric member accommodated within said cavity resonator, said dielectric member having end faces contacting respective electrode portions of said cavity resonator, and said cavity resonator having an opening formed therein adjacent one of said end faces to provide a region of said one end face of said inner dielectric member which is out of contact with said cavity resonator, and a resonant frequency adjusting member mounted on said support and adapted to be movable toward or away from said region, to adjust the resonant frequency of said dielectric resonator by varying a capacitance value in an electric field path passing through said columnar dielectric member, said resonant frequency adjusting member, and said cavity resonator, said resonant frequency adjusting member including a dielectric portion, an electrode portion being formed on a side thereof toward said columnar dielectric member.

12. A dielectric resonator as in claim 11, wherein said support comprises a casing for accommodating said cavity resonator, said frequency adjusting member being mounted on said casing.

13. A dielectric resonator as in claim 11, wherein said columnar dielectric member is accommodated substantially concentrically within said cavity resonator.

14. A dielectric resonator as in claim 11, wherein said resonant frequency adjusting member further has an electrode portion formed on a side thereof toward said electrode portions of said cavity resonator.

15. A dielectric resonator as in claim 11, wherein a recess is formed in said region, and said resonant frequency adjusting member is adapted to be movable toward or away from said recess.

* * * * *